US007413416B2

(12) United States Patent
Bratu

(10) Patent No.: US 7,413,416 B2
(45) Date of Patent: Aug. 19, 2008

(54) PROGRESSING CAVITY PUMP

(75) Inventor: Christian Bratu, Saint Nom la Breteche (FR)

(73) Assignee: PCM Pompes, Vanves (FR)

( * ) Notice: Subject to any disclaimer, the term of this patent is extended or adjusted under 35 U.S.C. 154(b) by 482 days.

(21) Appl. No.: 11/044,257

(22) Filed: Jan. 28, 2005

(65) Prior Publication Data

US 2005/0169779 A1 Aug. 4, 2005

(30) Foreign Application Priority Data

Jan. 30, 2004 (FR) ..... 04 00927

(51) Int. Cl.
*F04B 49/00* (2006.01)
*F04B 35/04* (2006.01)
*F01C 1/10* (2006.01)

(52) U.S. Cl. ..... 417/310; 417/410.4; 418/48

(58) Field of Classification Search ..... 418/48, 418/124, 88; 417/410.3–410.5, 310
See application file for complete search history.

(56) References Cited

U.S. PATENT DOCUMENTS 2,765,114 A 10/1956 Chang
4,424,013 A * 1/1984 Bauman ..... 418/48
5,722,820 A * 3/1998 Wild et al. ..... 418/48
6,149,385 A * 11/2000 Vilagines et al. ..... 415/199.1
6,241,494 B1 * 6/2001 Pafitis et al. ..... 418/48
6,457,958 B1 * 10/2002 Dunn ..... 418/1
6,474,939 B1 * 11/2002 Bratu ..... 415/74

FOREIGN PATENT DOCUMENTS

| | | |
|---|---|---|
| FR | 695 539 | 12/1930 |
| FR | 1 361 840 | 5/1964 |
| JP | 03 149377 | 6/1991 |
| RU | 1772423 | 10/1992 |

* cited by examiner

*Primary Examiner*—Charles G Freay
(74) *Attorney, Agent, or Firm*—Stites & Harbison PLLC; Douglas E. Jackson

(57) ABSTRACT

This progressing cavity pump includes a helical rotor (2) mounted to turn inside a helical stator (3). The stator (3) and the rotor (2) are disposed such that the cavities (4) formed therebetween move from the inlet (5) towards the outlet (6). In this cavity pump, hydraulic regulation (HR) means are provided for obtaining internal recirculation of the pumped fluid between at least two of the cavities (4) under conditions capable of performing at least one function selected from: achieving the desired pressure distribution along the pump, stabilizing the temperatures, controlling the leakage flow rates, and compensating for the volumes of compressed gas.

12 Claims, 7 Drawing Sheets

A
B
m
2
4
7
10
11
ℓ

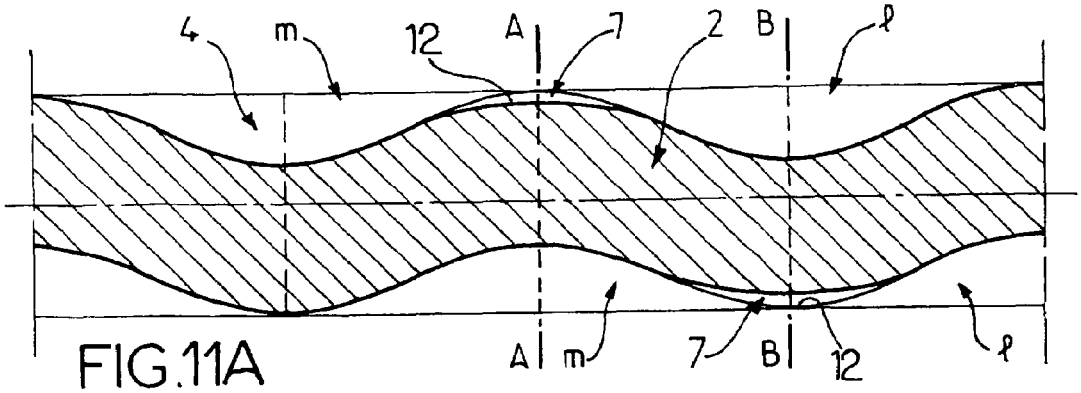
FIG.11A
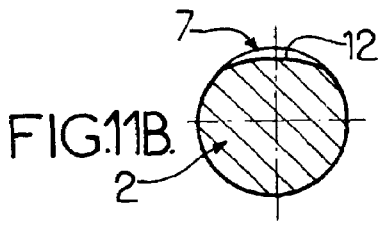
FIG.11B.
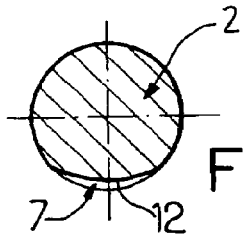
FIG.11C.
FIG.12A.
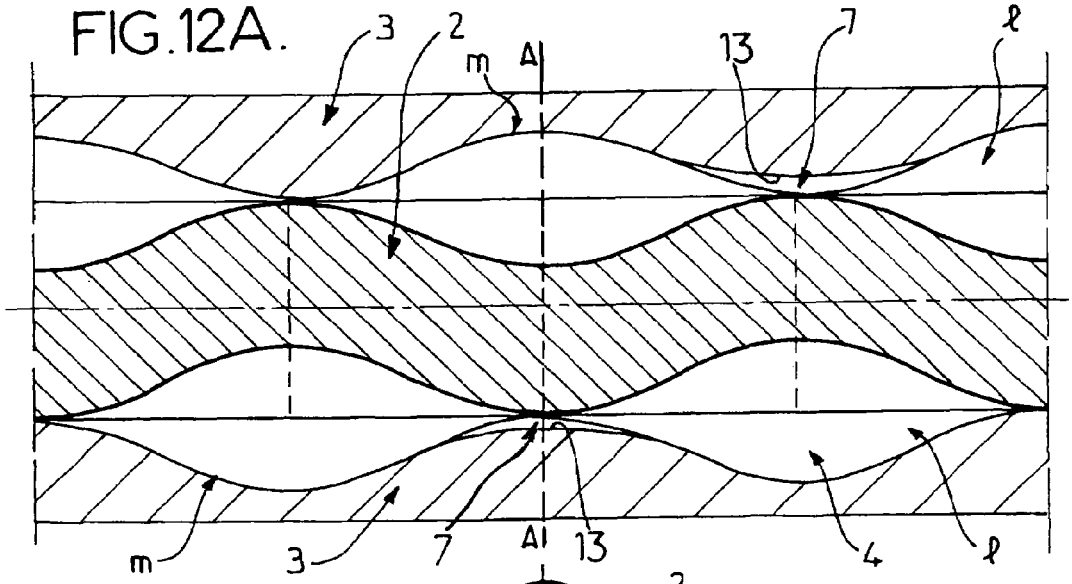
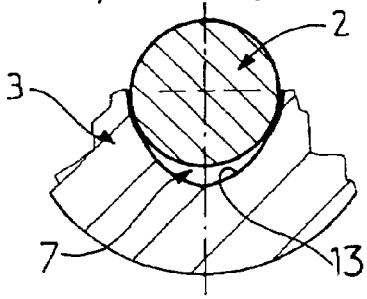
FIG.12B.

PROGRESSING CAVITY PUMP

FIELD OF THE INVENTION

The present invention relates to improvements made to positive displacement pumps of the progressing cavity type, also known as "Moineau pumps", and more specifically it relates to an improved positive displacement pump of the progressing cavity type, making it possible to pump single-phase or multi-phase mixtures or effluents of any viscosity, and in particular compressible multi-phase mixtures or effluents and fluids that are viscous to very viscous.

The term "compressible multi-phase mixture or effluent" is used to mean a mixture of:

(a) a gas phase formed of at least one free gas; and (b) a liquid phase formed of at least one liquid and/or (c) a solid phase formed of the particles of at least one solid in suspension in (a) and, if phase (b) is present, in (a) and/or (b).

However, as indicated above, the pump of the present invention naturally also makes it possible to pump a single phase or a liquid phase charged with solid particles, of various viscosities.

DESCRIPTION OF THE PRIOR ART

The progressing cavity pump, also referred to below as the "PCP", was invented by René Moineau in 1930, and. the way industrial pumps in current use operate when pumping liquid corresponds to its basic principles.

FIG. 1 of the accompanying drawing gives, in its portion referenced (A), a diagrammatic view partially in longitudinal axial section of a conventional PCP, while its portion referenced (B) gives a representation of the pressure distribution along the pump while a liquid is being pumped (curve L) and while a liquid-gas multi-phase mixture is being pumped (curve P).

The architecture of the PCP 1 is constituted by a helical metal rotor 2 mounted to turn inside a compressible stator 3 that is generally made of elastomer and whose inside shape is helical. The contact between the rotor 2 and the stator 3 takes place by compressing the stator 3 to various extents. For this purpose, the rotor 2 has a diameter D (FIG. 2(B)) that is greater than the diameter of the channel of the stator 3 (FIG. 2(C)), thereby generating contact by the stator 3 being compressed by the rotor 2 (contact tightening), thereby providing a certain level of sealing (FIG. 2(A)).

As shown in FIGS. 1(A) and 2(A), the shape of the rotor 2 and the shape of the stator 3 of the PCP 1 lead to a set of isolated cavities or "cells" 4 being formed, defined between the rotor 2 and the stator 3, which cavities are of constant volume and are displaced by the rotor 2 from the suction end or inlet 5 (low inlet pressure $P_A$) towards the delivery end or outlet 6 (high outlet pressure $P_R$). In this sense, the PCP is a positive displacement pump.

In the description below, the term "stage" is used sometimes instead of the term "cavity"; the term "stage" is used to mean the volume between the stator and the rotor that corresponds to a cavity at some given time. The two terms are sometimes used interchangeably.

FIG. 2 of the accompanying drawing shows a known PCP 1 shown at (A) in the assembled state and having a single-helix rotor 2 shown on its own at (B), and a double-helix stator 3 shown on its own at (C). The axis of the stator is designated by $a_s$ and the axis of the rotor is designated by $a_r$. Under these conditions:

the pitch ($P_s$) of the stator 3 is twice the pitch ($P_r$) of the rotor 2; and the length L of a cavity 4 is equal to the pitch ($P_s$) of the stator 3, and it is therefore twice the pitch ($P_r$) of the rotor 2.

The pressure distribution (FIG. 1(B)) along the pump 1 from the outlet 6 to the inlet 5, and the lubrication of the contact between the rotor 2 and the stator 3 are due to leaks flowing between the rotor 2 and the stator 3. A high-pressure cavity 4 discharges into the adjacent cavity 4 at a lower pressure due to the leaks because the contact between rotor 2 and stator 3 is not entirely leaktight, and the head losses generate the pressure difference between the cavities 4. Therefore, the leakage flow rate depends on the tightness of the contact between the rotor 2 and the stator 3, on the dynamic conditions of their contact (speed of rotation, vibration), on the viscosity of the fluid, and on the difference between the local pressures. In practice, it is difficult to control the leakage flow and the pressure distribution that it generates.

In other words, the hydraulic operation of the PCP is subjected to regulation that is external to the cavities, due to the leaks between the rotor 2 and the stator 3, said regulation not being controlled.

When the PCP 1 is used for pumping a multi-phase mixture including a gas phase, the cavity 4 moves from the low pressure at the inlet 5 to the high pressure at the outlet 6, and the presence of the gas in the pumped effluent leads to a process of compression whereby the gas is compressed, accompanied by a rise in temperature, because the cavity is of constant volume. The ideal gas law shows that, if the volume in which the gas is compressed remains constant, the temperature rises considerably. Thus, the leakage flow rate via the annular contact between rotor 2 and stator 3 performs two functions: it compensates in part for the volume of gas compressed, and it provides the pressure difference between the cavities 4. However, the annular leakage flow rate between the rotor 2 and the stator 3 of the PCP 1 is adapted to operating with a liquid (an incompressible fluid), for lubrication purposes at low flow rates; it is not sufficient to compensate for the compression of the gas. Since the leakage flow rate is low, the last cavities 4 are compensated in part only, and compression occurs over the last stages of the pump, as can be seen in FIG. 1(B), in which, as already indicated, $p_A$ designates the pressure at the inlet and $p_R$ designates the pressure at the outlet. This compression is accompanied by a high temperature. The concentration of the pressures at the outlet of the pump and the large increase in the temperature gives rise to a risk of mechanical damage: degradation of the stator, mechanical expansion, and vibration.

Therefore, the concept of leakage via contact between the rotor and the stator, which concept is specific to the PCP, is unsuitable for pumping a compressible multi-phase mixture.

In practice, in the presence of gas, the PCP achieves a pressure of 4 MPa (i.e. 40 bars) on the last four stages, with a steep pressure gradient that develops high temperatures; out of thirteen stages, there are only four that compress the mixture.

In general, the non-uniform pressure distribution along the PCP leads to excessive temperatures developing that jeopardize the reliability of the pump: degradation of the elastomer of the stator, dynamic instability of the rotor, and thermal forces and deformation of the structure. Under such conditions, the outlet pressure must be limited and the speed of rotation of the pump must be reduced, thereby leading to degradation of pumped flow rates.

Experience shows that almost-leaktight contact between the rotor and the stator can lead to the development of cavitation when the PCP is conveying viscous liquid, in particular for high pumping flow rates or when the pressure at the inlet is low. The appearance of cavitation is highly damaging to the strength of the elastomer stator and of the rotor, and thus to the reliability of the system.

Various technical solutions for making the pressures more uniform along a PCP have been proposed:

It has been proposed to implement a rotor/stator pair whose cavity volume decreases from the inlet towards the outlet.

Thus, U.S. Pat. No. 2,765,114 proposes a frustoconical rotor/stator system, with decreasing diameters.

Along the same lines, it is possible to imagine a rotor of varying pitch whose cavity volume decreases going towards the outlet.

Those solutions are effective only for a fixed proportion of gas and they are detrimental to operation with liquid. In addition, those solutions cannot avoid the appearance of cavitation.

In addition, the modification of the architecture of the pump leads to a complex manufacturing process without guaranteeing good reliability.

It has also been proposed to implement contact between the rotor and the stator that varies along the pump.

If contact between the rotor and the stator is implemented such that the annular leakage flow (between the rotor and the stator) is higher in the vicinity of the outlet and lower at the inlet end, the compensation for the volume of compressed gas takes place under more favorable conditions and the pressure distribution is improved.

Thus, U.S. Pat. No. 5,722,820 proposes varying contact between the rotor and the stator, with contact decreasing going from the outlet to the inlet.

In order to implement that system, various means are proposed: a rotor varying frustoconically to a small extent, or a frustoconical stator, or a combination of both.

Under such conditions, the leakage flow between the rotor and the stator conveys the flow rate necessary for achieving pressure and volume compensation for the cavities situated downstream in the pump. It is an overall leakage flow rate; it compensates the last cavity first, and then goes to the preceding cavity and so on.

In order to feed a plurality of cavities whose compression ratio is large, a high leakage flow rate is necessary, which requires very little contact between the rotor and the stator. However, the mechanical and hydraulic operation of the PCP requires contact between the rotor and the stator in order to guarantee dynamic stability and hydraulic efficiency.

That solution can thus only be a compromise between operating with liquid, like a PCP, and conveying gas; it is for that reason that its use in practice is limited to low flow rates of gas.

In addition, the tightness of the contact between the rotor and the stator is suitable only for a fixed proportion of gas, and it is detrimental to efficiency with liquid.

With a viscous fluid, the pump cannot avoid the appearance of cavitation.

In addition, that solution modifies the architecture of the pump and complicates the manufacturing process.

Therefore, that solution can have only limited use, and it involves a complex architecture without guaranteeing good reliability.

SUMMARY OF THE INVENTION

An object of the present invention is to propose a pump that is improved so as to overcome the above-mentioned drawbacks of the prior state of the art.

To these ends, a progressing cavity pump including a helical rotor mounted to turn inside a helical stator, said stator and said rotor being disposed such that the cavities formed between said rotor and said stator move from the inlet towards the outlet, is characterized by the fact that hydraulic regulation means are provided for obtaining internal recirculation of the pumped fluid between at least two of said cavities under conditions capable of performing at least one function selected from: achieving the desired pressure distribution along the pump, stabilizing the temperatures, controlling the leakage flow rates, and compensating for the volumes of compressed gas.

The term "internal recirculation" is used to mean recirculation between two cavities of a volume of pumped mixture as opposed to recirculation external to the cavities that takes place by annular contact between the rotor and the stator and that generates a leakage flow rate.

The pressure distribution is obtained by re-balancing the local pressures due to the recirculation flow rate of the hydraulic regulators.

The leakage flow rates between the stator and the rotor are functions of the pressure gradient. Controlling the pressures leads to controlling the leakage flow rates.

The compressed volumes are compensated by the recirculation flow rate of the hydraulic regulators.

The hydraulic regulation means thus serve to control the behavior of the pump, as a function of the production characteristics.

Controlling the pressures and compensating for the volume of compressed gas stabilize the temperatures, for multi-phase (liquid, gas, and solid particles) pumping.

By controlling the pressures, it is possible to avoid appearance of cavitation, which is a source of mechanical damage (to the elastomer of the stator, and to the metal of the rotor); and balancing the pressures and controlling the leakage flow rate lead to controlling the contact between the stator and the rotor.

Internally regulating the pressure by means of the hydraulic regulation system of the present invention leads to stabilizing the thermal and hydraulic state along the pump, and thereby makes it possible to improve mechanical behavior and overall reliability.

Under these conditions, controlling the hydro-thermo-mechanical behavior guarantees improved hydraulic performance (pumped flow rate, and outlet pressure) and improved economic performance (maintenance, and length of life).

Controlling the contact between the rotor and the stator means that it is possible to have surface contact without high compression between stator and rotor, while preserving a low leakage flow-rate. This is an operating mode that is novel compared with a conventional PCP.

Under these conditions:

the reliability of the system is improved; and it is possible to use materials that are more rigid (stronger) for the stator in order to increase the speed of rotation and the flow rate of the pump.

Thus, the operating principle of the pump of the present invention is novel and very different compared with existing systems:

the PCP with frustoconical contact between the rotor and the stator that is in current use is an external overall regulation system whose limited leakage flow rate compensates only those cavities which are situated close to the outlet of the pump;

the pump of the present invention includes internal hydraulic regulation means obtaining local recirculation flow between two cavities for compensating for the local pressure difference, for the leakage flow rate and for the compression of the gas contained in the cavity;

the recirculation flow rate is self-regulated by the proportion of gas and by the pressure difference.

The hydraulic regulation means are advantageously arranged to obtain internal recirculation of the pumped fluid between at least two adjacent cavities. In particular, said means may advantageously be arranged to obtain internal recirculation of the pumped fluid between at least two cavities situated in the region of the pump that is in the vicinity of the outlet. Said means may also be arranged to obtain internal recirculation of the pumped fluid between all of the cavities of the pump.

The hydraulic regulation may be received at least in part by the rotor and/or at least in part by the stator.

To this end, a set of hydraulic regulators are advantageously installed inside the pump, the dimensioning and the number per unit length along the pump of said hydraulic regulators being such as to obtain hydraulic regulation that is uniform and that consists in controlling the pressures, in controlling the leakage flow rates and the temperatures, and in compensating for the compressed volumes. Rotation of the rotor causes the cavities to move along the pump at a speed dependent on the speed of rotation and on the pitch of the rotor; each time that a cavity goes past a hydraulic regulator, the recirculation flow rate compensates for the compressed volume, re-balances the pressures, and stabilizes the temperatures.

Therefore, the spread of hydraulic regulators along the pump guarantees that the process of regulation is continuous along the pump; said spread is a function of the performance of the pump (flow rate, and pressure distribution).

At the same time, the dimensioning of the hydraulic regulators corresponds to the recirculation flow rate necessary for the cavity in order to compensate for the compressed volume and in order to re-balance the pressures.

Under these conditions, operation of the hydraulic regulators is self-regulated; the recirculation depends on the pressure and vice versa.

In a first particular embodiment, the hydraulic regulation means for obtaining internal recirculation of the pumped fluid between two cavities include at least one channel provided in the rotor and interconnecting the two cavities, the hydraulic regulation being performed mechanically by means of a regulator disposed inside said channel and/or by head loss.

In a second particular embodiment, the hydraulic regulation means obtaining internal recirculation of the pumped fluid between two cavities comprise at least one peripheral channel received by the rotor and arranged to form the link between the two cavities with regulation by head loss.

In a third particular embodiment, the hydraulic regulation means for obtaining internal recirculation of the pumped fluid between two cavities comprise at least one internal hydraulic channel received by the stator and arranged to form the link between said two cavities with regulation by head loss.

All three particular embodiments may be used simultaneously in the same pump.

According to an advantageous characteristic of the present invention, the contact between the rotor and the stator may be less relaxed with respect to a progressing cavity pump that does not include hydraulic regulation means as defined above. Under these conditions, it is possible to increase the speed of rotation and the pumped flow rate without damaging the stator.

The present invention also provides the use of the pump as defined above, for pumping compressible multi-phase mixtures and for pumping viscous fluids.

The industrial uses of the pump of the present invention cover a field that is broader than the field of existing PCPs.

In addition to the above-mentioned uses for conveying multi-phase mixtures in the fields of chemicals and of petroleum, mention can be made of pumping at high flow rates (e.g. for petroleum, etc.), and pumping at low inlet pressures (horizontal oil wells).

BRIEF DESCRIPTION OF THE DRAWINGS

In order to illustrate the present invention more clearly, particular embodiments thereof are described below merely by way of non-limiting example and with reference to the accompanying drawings, in which:

FIG. 11A is a view of a pump segment of the invention, showing the hydraulic regulator (HR) made up of two channels peripheral to the rotor, mutually offset by 180° and by one half of the pitch of the rotor, and serving to recirculate the pumped fluid between two adjacent cavities l, m;

FIGS. 11B and 11C are views in section respectively on line A—A and on line B—B of FIG. 11A;

FIG. 12A is a view of a pump segment of the invention, showing the hydraulic regulator (HR) made up of a peripheral hydraulic channel inside the stator, and serving to recirculate the pumped fluid between two adjacent cavities l, m; and FIG. 12B is a view in section on line A-A of FIG. 12A.

DETAILED DESCRIPTION OF THE INVENTION

Figure 1:
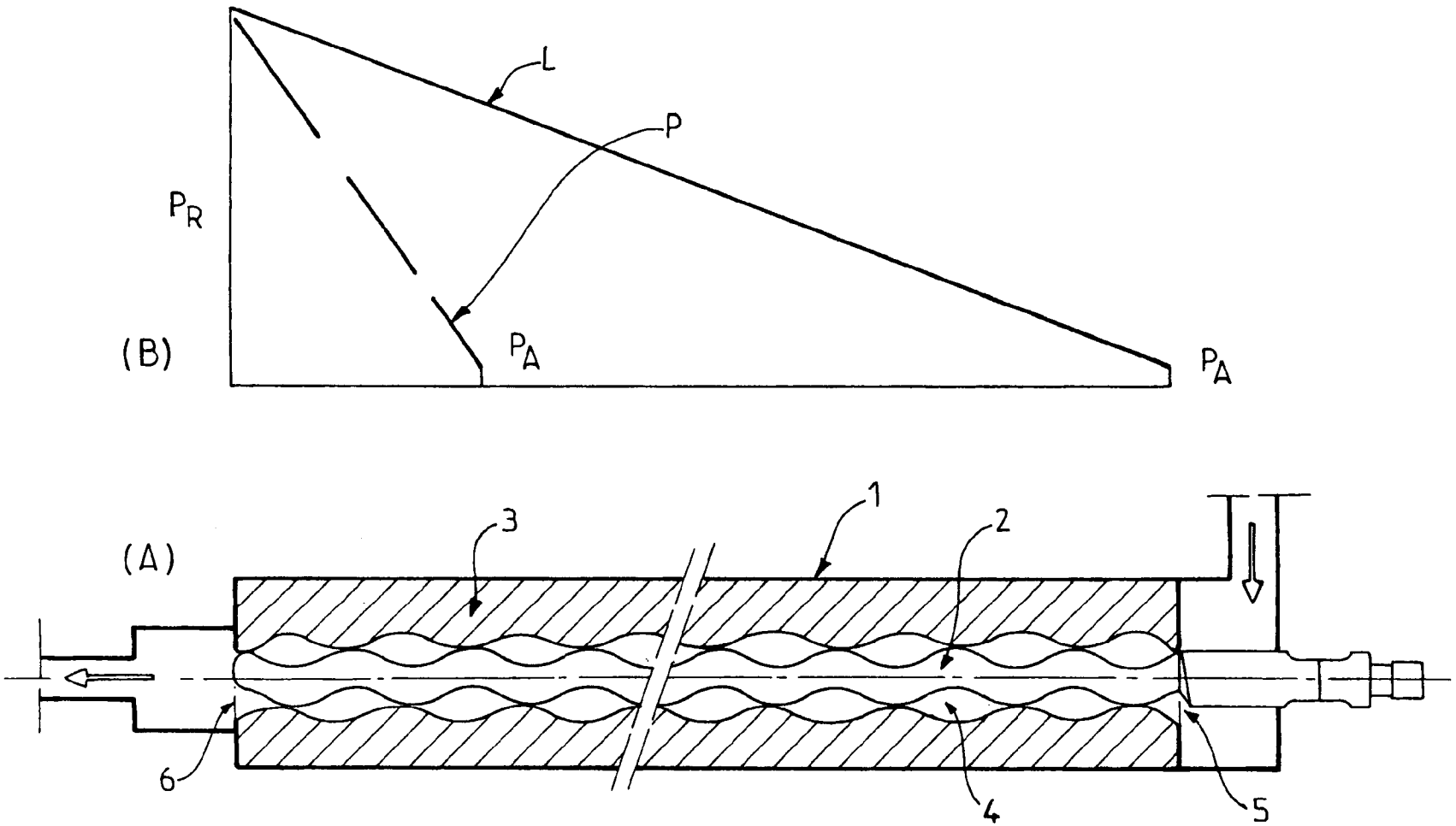
FIG. 1 shows a conventional PCP as described above, and also shows the pressure distributions when pumping a liquid and a multi-phase liquid-gas mixture.
Figure 2:
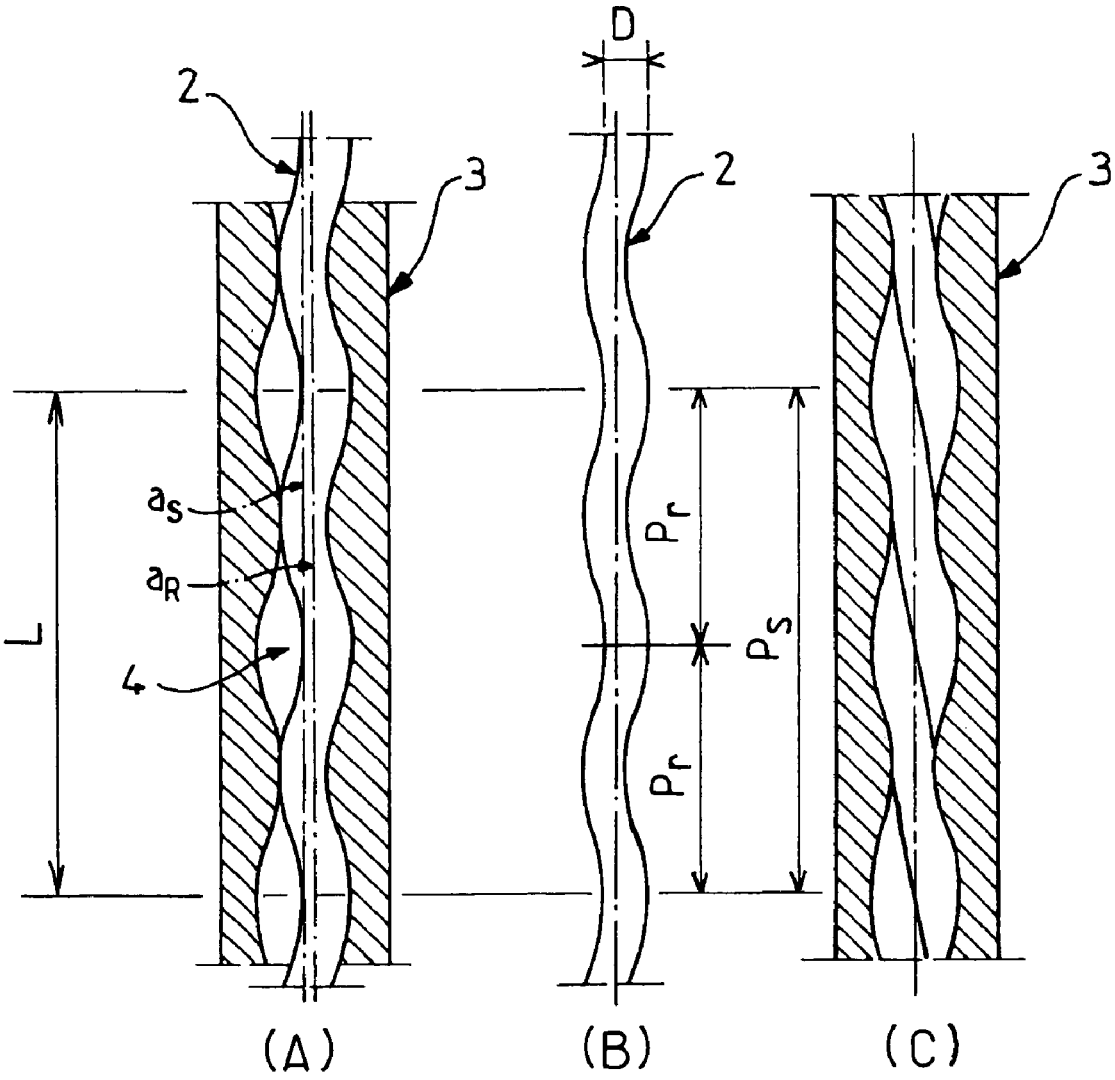
FIG. 2 shows the make-up of a PCP with a rotor having a single helix and a stator having a double helix.
Figure 3:
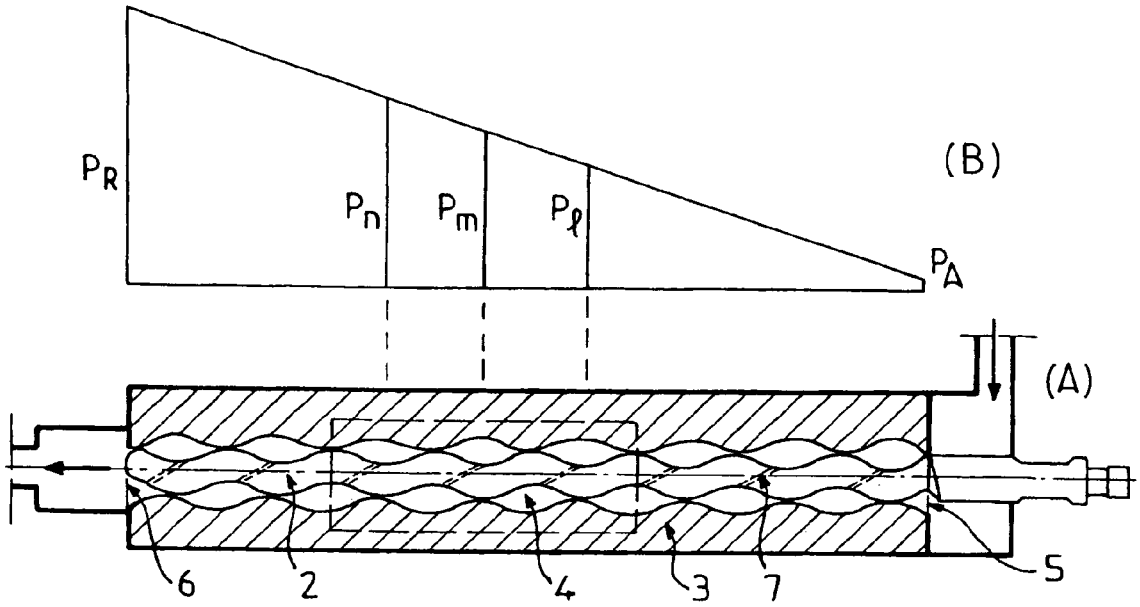
FIG. 3 is a view analogous to FIG. 1, its portion (A) showing a progressing cavity pump of the present invention, with the hydraulic regulators (HRs) being shown diagrammatically, and its portion (B) showing that the pressure distribution during multi-phase pumping is uniform along the pump.
Figure 4:
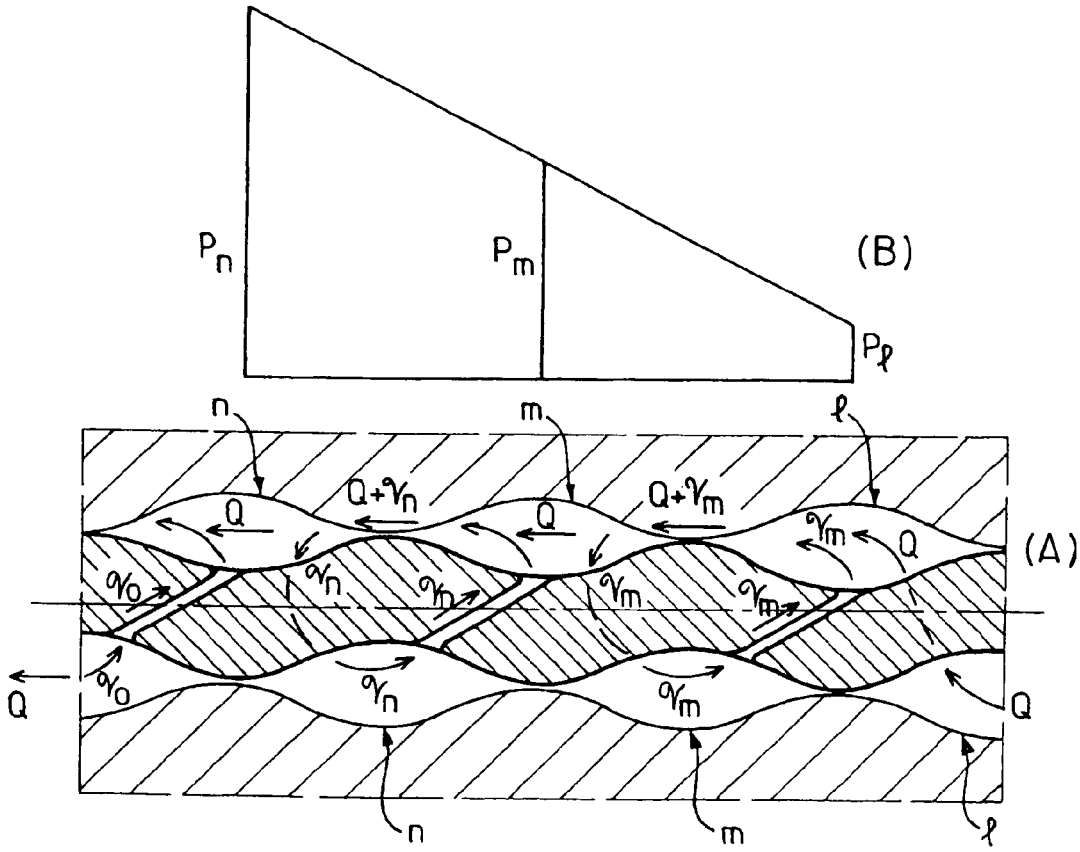
FIG. 4 shows a view analogous to FIG. 3 on a larger scale, its portion (A) showing a segment of the pump of the invention, making it possible to describe the local recirculation mechanism for compensating for the compressed volumes and for re-balancing the local pressures, in three successive cavities of the pump, respectively l, m, and n, and its portion (B) showing the pressure distribution along the pump.

FIGS. 3 and 4 show operation of the hydraulic regulator (HR) device of the invention as installed inside the pump.

The following symbols are used as defined below:

$Q=Q_L+Q_G$: the total flow rate of the mixture of liquid (L) and of gas (G);

Q: flow rate of recirculation between the cavities; e.g. $q_m$ is the flow rate of the hydraulic regulator device for hydraulic regulation from the cavity m to the cavity l;

P: local pressure, in the cavities (l, m, n);

ζ: coefficient of head loss of the hydraulic regulator device;

S: flow section of the hydraulic regulator device;

γ: coefficient of adiabatic transformation.

The total flow rate Q enters the cavity l and the volume of gas is compressed to the pressure $p_l$. Because of the difference between the pressures ($p_m-p_l$), the flow rate $q_m$ of the hydraulic regulation system compensates for the compressed volume in the cavity l and re-balances the pressures $p_m$ and $p_l$.

The total flow rate ($Q+q_m$), compressed to the pressure $p_l$ goes into the cavity m;

- the recirculation flow rate $q_m$ returns through the hydraulic regulator circuit towards the cavity l;
- the flow-rate Q advances inside the cavity m, pushed by the rotor;
- due to the pressure $p_m$, which is greater than the preceding pressure $p_l$, the volume of gas is compressed;
- the pressure difference ($p_n-p_m$) generates a flow rate $q_n$ in the hydraulic regulation system, from the cavity n towards the cavity m, in order to compensate for the compressed volume in the cavity m and in order to re-balance the pressures $p_n$ and $p_m$;
- the total flow rate ($Q+q_n$) advances inside the cavity n; the recirculation flow-rate $q_n$ returns through the hydraulic regulator (HR) towards the cavity m; and
- the flow rate Q of the pump is compressed, the hydraulic regulation system discharges in order to compensate for the compression and in order to re-balance the pressures.

The process is repeated for each cavity, going towards the outlet.

Therefore, the local recirculation via the hydraulic regulation (HR) system achieves internal regulation, between the cavities:

- it locally re-balances the pressures between two cavities, thereby making the pressure distribution along the pump uniform;
- it compensates for the compressed volumes, thereby preventing temperature from rising;
- the pumped flow-rate Q remains constant; the recirculation of the invention takes place without loss of flow rate;
- by re-balancing the pressures, the leakage flow rates are controlled as is the contact between rotor and stator.

The local operation of the hydraulic regulation system of the invention is in total contrast with the systems currently used by industry: it is a controlled internal regulation, in contrast with the non-controlled external regulation of current systems.

Performance is controlled by the architecture of the hydraulic regulation system: dimensions, transfer function, spread along the pump.

In view of its local operation, the hydraulic regulation system is dimensioned using the methods of compressible fluid mechanics and of thermodynamics.

Thus, the dimensions and the recirculation flow rate are functions of the flow rate of gas and of liquid, of the pressure difference, and of the hydraulic characteristics of the HR (head loss, transfer function):

$$Q_n=f\{Q_G,Q_L,(p_m/p_n)^{1/\gamma},p_n,p_m,S,\zeta\} \quad [1]$$

From a thermodynamic point of view, the local pressures and the recirculation flow rate (q) are related by the relationship [2]:

$$[p_m/p_n]^{1/\gamma}=1+q_n/Q_G \quad [2]$$

Therefore, the variation in the local pressure [2] depends on the recirculation flow-rate [1] and, in reciprocal manner, the recirculation flow rate depends on the local pressures.

At equilibrium, the distribution of the local pressure results from the head loss in the hydraulic regulation system, which determines the dimensions of the hydraulic regulation system [1].

From a practical point of view, the pressure gradient along the pump to be reached under multi-phase conditions is set, then the recirculation flow-rate [2] and the dimensions of the hydraulic regulation system [1] that correspond to the required distribution of pressures are determined.

For pumping liquid, the hydraulic regulation system regulates, from the inside, the pressure distribution and the leakage flow rate, which corresponds to controlling the hydraulic operation of the pump, with the aims of:

- avoiding appearance of cavitation, and the damage that such cavitation causes to the stator and to the rotor;
- controlling contact between rotor and stator: leakage flow rate, and lubrication of the contact between the rotor and the stator; and
- obtaining improved reliability and increasing the hydraulic efficiency: flow rate, outlet pressure, length of life, maintenance.

This is in total contrast with a current PCP, in which hydraulic operation by externally regulating pressures and leaks is not controlled.

Under these conditions, the hydraulic regulation systems are installed inside the pump by adapting the rotor and/or the stator, without completely changing the overall initial architecture of the PCP and manufacturing thereof. Retaining the initial configuration of the PCP means that the overall architecture (the rotor and the stator) is not modified, nor is the conveying of the mixture by moving the cavities, and nor are the drive means.

The results obtained in a pump of the invention under two-phase (gas and liquid) production conditions demonstrate the effectiveness of the system; controlling the pressure distribution along the pump (distribution rendered uniform) and controlling the thermal state (stabilized). When pumping liquid, control of hydraulic operation without cavitation was confirmed.

FIGS. 5 to 12 show particular embodiments of a pump of the invention.

Figure 5A:
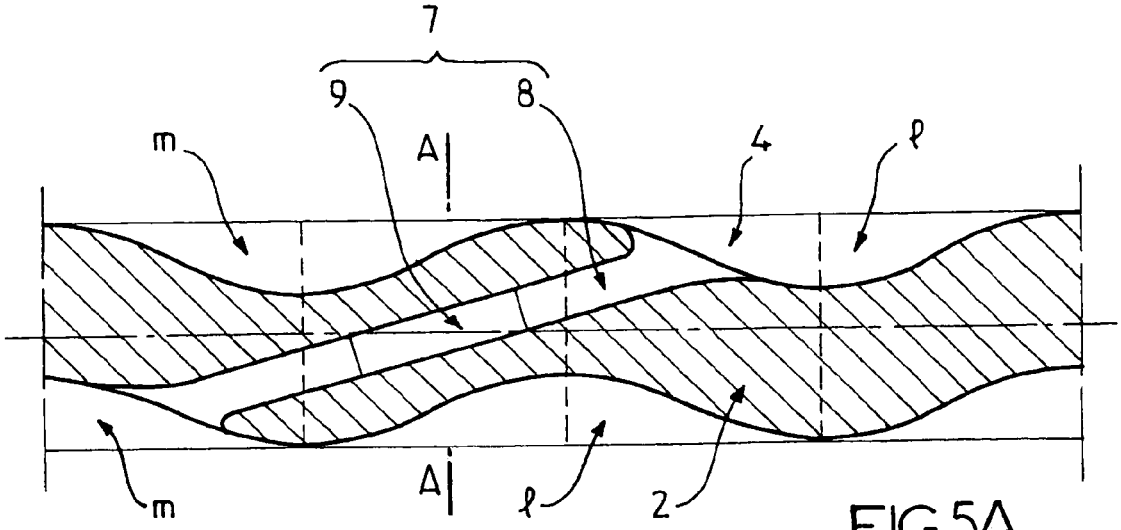
FIG. 5A is a view analogous to FIG. 4 on an even larger scale, showing a pump segment of the invention, showing the hydraulic regulator (HR) comprising a channel provided in the rotor and serving to recirculate the pumped fluid between two adjacent cavities l, m, with mechanical regulation being provided.
Figure 5B:
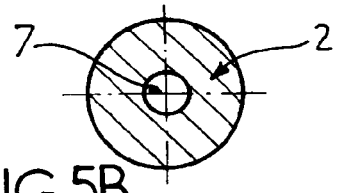
FIG. 5B is a view in section on line A-A of FIG. 5A.

In FIGS. 5A and 5B, the hydraulic regulation (HR) system 7 is constituted by a hydraulic channel 8 that is provided inside the rotor 2 between two cavities 4 and in which a regulator device 9 is installed for regulating the recirculation flow rate.

Figure 6:
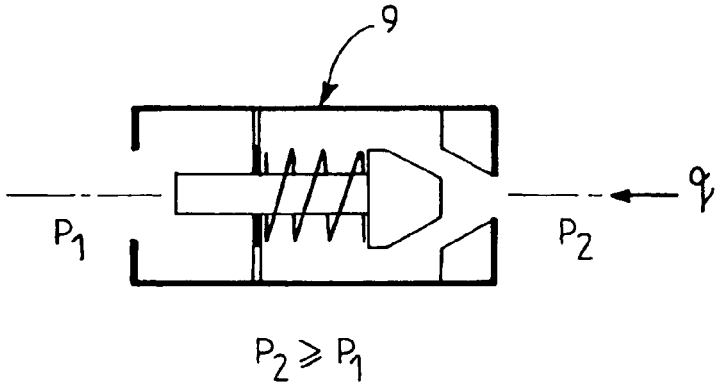
FIG. 6 is a view on an even larger scale, showing the mechanical regulator of FIG. 5.

A practical embodiment of the device 9 is shown diagrammatically in FIG. 6, in which it can be seen that said device is based on a valve opening gradually at a given pressure difference, thereby regulating the recirculation flow rate q (FIG. 4(A).

Figure 7A:
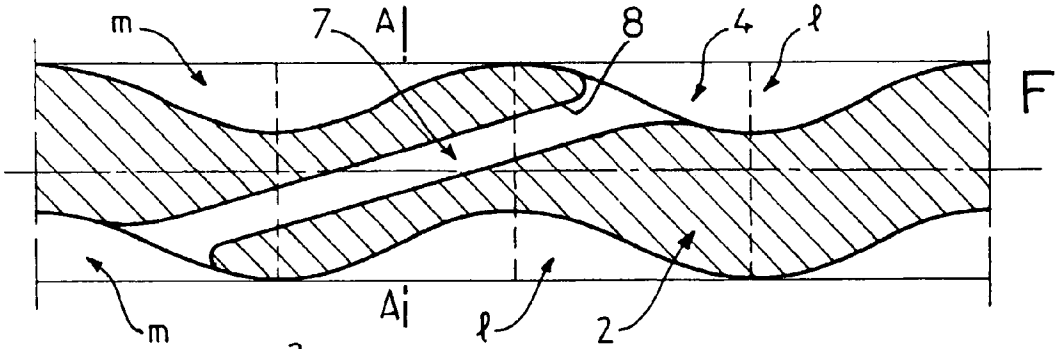
FIG. 7A is a view analogous to FIG. 5A, but with hydraulic regulation being by head loss.
Figure 7B:
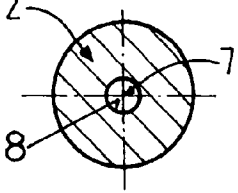
FIG. 7B is a view in section on line A—A of FIG. 7A.

In FIGS. 7A and 7B, the hydraulic regulation (HR) system 7 is constituted by a hydraulic channel 8 provided inside the rotor 2 between two cavities 4.

The head losses at the inlet, along, and at the outlet of the channel 8 regulate the flow rate and the pressure difference.

In FIGS. 8A-8C and 9A-9C, the hydraulic regulation (HR) system 7 is constituted by two hydraulic channels 10, one of which is provided between the cavities l and m, and the other is provided inside the cavity l. The two channels in tandem, disposed in offset manner, represent the simplest structure. The fact that a plurality of channels are provided reduces their diameter, and the offset guarantees better circulation, in particular as the opening in the channel passes into contact with the stator.

Figure 8A:
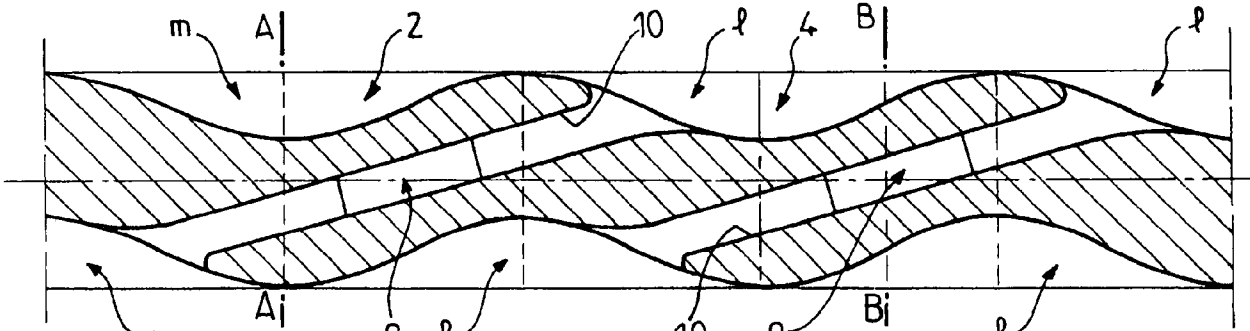
FIG. 8A is a view of a pump segment of the invention, showing the hydraulic regulator (HR) made up of two parallel channels provided in the rotor and serving to recirculate the pumped fluid between two adjacent cavities, l, m, with mechanical regulation being provided.
Figure 8C:
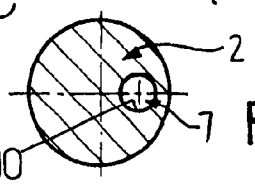
FIGS. 8B and 8C are views in section respectively on line A—A and on line B—B of FIG. 8A.
Figure 8B:
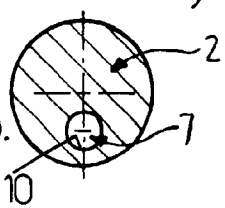
Figures 9A, 9B, 9C, 10A, 10B:
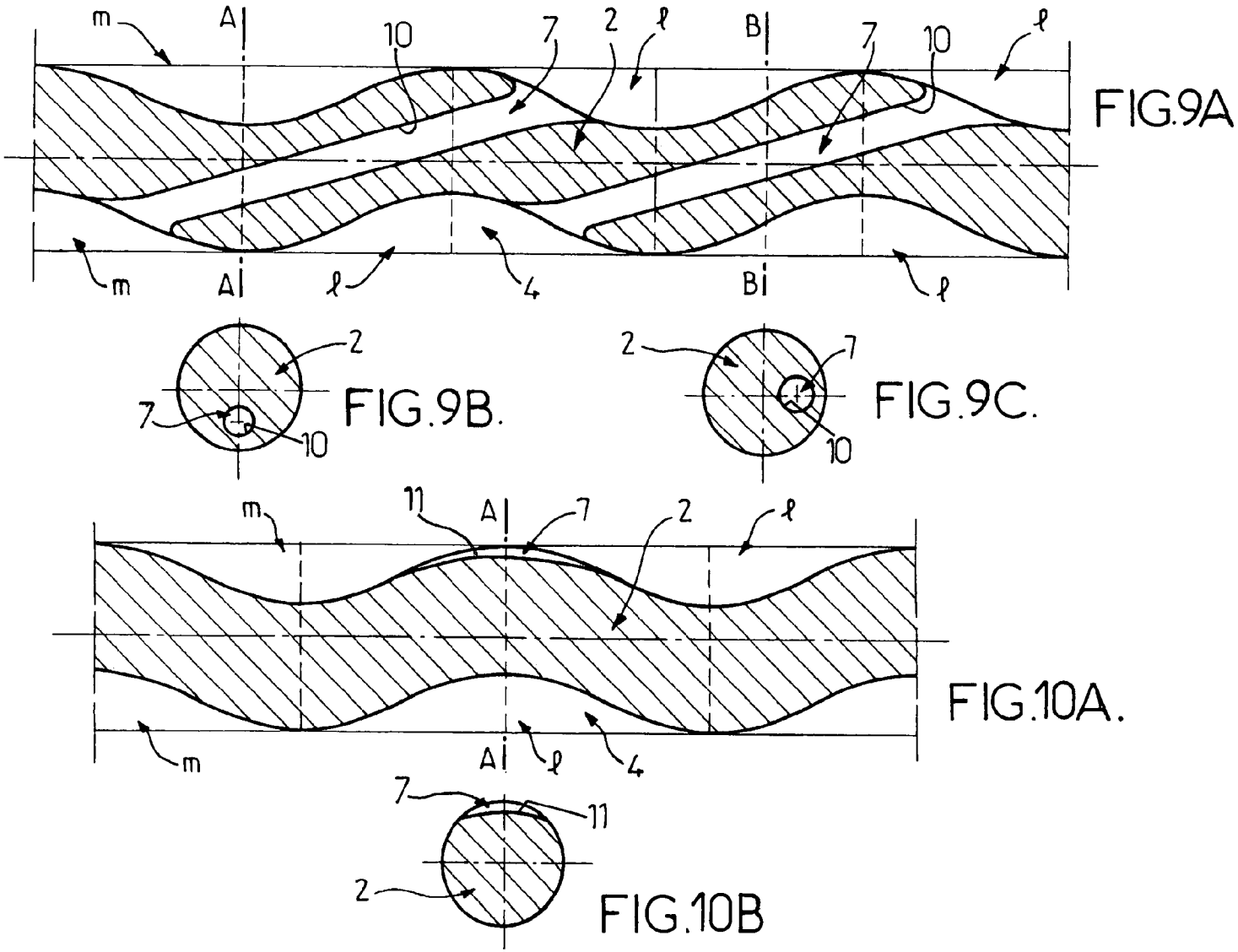
FIG. 9A is a view analogous to FIG. 8, but with regulation being by head loss.
FIGS. 9B and 9C are views in section respectively on line A—A and on line B—B of FIG. 9A.
FIG. 10A is a view of a pump segment of the invention, showing the hydraulic regulator (HR) made up of a hydraulic channel peripheral to the rotor and serving to recirculate the pumped fluid between two adjacent cavities l, m.
FIG. 10B is a view in section on line A—A of FIG. 10A.

FIGS. 8A-8C show a variant, in which a flow-rate regulator device 9, such as the device shown in FIG. 6, is installed in each of the channels 10 of the tandem, and FIGS. 9A-9C show a variant in which, in each channel 10 of the tandem, the hydraulic regulation takes place by head loss, as shown in FIGS. 7A, 7B.

In FIGS. 10A, 10B, and 11A-11C, the hydraulic regulation (HR) system 7 is implemented by a hydraulic channel that is peripheral to the rotor 2, between two cavities 4. Thus, it provides recirculation between the two cavities 4 and the pressure difference is given by the head loss of the flow. Its dimensions correspond to the recirculation flow rate that is necessary.

FIGS. 10A, 10B show a variant including a circuit having a single peripheral hydraulic channel 111, and FIGS. 11A-11C show a variant including two circuits 12 in offset tandem.

In FIGS. 12A, 12B, the hydraulic regulation system (HR) 7 includes a peripheral hydraulic channel 13 that is inside the stator 3, and that is provided between two cavities 4.

As in the preceding case, it provides recirculation between two cavities, the pressure difference is given by the head loss, and its dimensions correspond to the recirculation flow rate.

The following examples illustrate results obtained with the pump of the invention without however limiting the scope thereof.

EXAMPLE 1

This test related to a prototype of a conventional PCP conveying a multi-phase mixture (water and air).

A PCP having thirteen stages (cavities) conveyed a multi-phase mixture delivering 50% water and 50% air, with an inlet pressure of 0.1 MPa (1 bar) and a pressure in the outlet duct of 4 MPa (40 bars), resulting in a gas compression ratio of 40/1. Because of the high compression ratio and because the leakage flow rate (between the rotor and the stator) was incapable of compensating for the compressed gas volume, the outlet pressure was achieved over the last four stages (cavities), resulting in a large pressure gain of 1 MPa (10 bars) per stage. All of the work of the pump was achieved by the last four stages, the remaining nine stages of the pump not contributing to compression of the mixture. That high compression concentrated on the last stages was accompanied by a large increase in temperature: the inlet temperature was multiplied by two.

Such high temperature and such concentration of the pressures at the outlet of the pump are detrimental to the overall mechanical strength, in particular the strength of the elastomer of the stator, and the strength of the rotor.

EXAMPLE 2

This test related to a prototype of a PCP improved with Hydraulic Regulators (HRs) and conveying a multi-phase mixture (water and air).

The pump of the present invention behaved quite differently; by means of the hydraulic regulators HRs installed in the rotor, the pressure distribution was rendered uniform, and the temperature was stabilized. Over the last four stages, the spread of hydraulic regulators HRs was two hydraulic regulators per stage and therefore the pressure gain was very small (about 0.1 MPa per stage). Over the remaining nine stages of the pump, the hydraulic regulators HRs were spread at one regulator HR per stage. Under these conditions, the pressure distribution was rendered uniform, resulting in a pressure gain of about 0.3 MPa (3 bars) per stage.

Therefore, rendering the pressure distribution along the pump uniform results in a small pressure gain for each stage, and in stabilization of the temperatures along the pump.

The variation in the spread of the hydraulic regulators HRs contributes to hydro-thermodynamically re-balancing the pump; all of the stages contribute to compression of the mixture.

EXAMPLE 3

This test related to a prototype of a conventional PCP conveying a liquid (water).

The same PCP conveyed water with low pressure at the inlet (0.1 MPa (1 bar)) and a pressure of about 0.5 MPa in the outlet duct. Because of the dynamic behavior of the contact between the rotor and the stator, that pump developed very low pressures over stages 7 to 11, with a risk of cavitation.

Appearance of cavitation leads to damage of the materials, in particular the elastomer of the stator and the metal of the rotor.

EXAMPLE 4

This test related to a prototype of a PCP improved with the Hydraulic Regulators (HRs) and conveying a liquid (water).

By means of the hydraulic regulators (HRs), the pump of the present invention controlled the pressure distribution and, therefore, the pressures were positive and uniformly distributed, without any risk of cavitation. From the outlet at 0.5 MPa (5 bars), the pressures varied uniformly to the inlet pressure 0.1 MPa (1 bar), without ever locally reaching low cavitation pressures.

What is claimed is:

1. A progressing cavity pump comprising:

a helical rotor mounted to turn inside a helical stator, said stator and said rotor being disposed such that during turning isolated cavities formed between said rotor and said stator move from an inlet towards an outlet, a hydraulic regulation means for generating internal recirculation of a pumped fluid between at least two of said isolated cavities, whereby there is achieved at least one function selected from: achieving the desired pressure distribution along the pump, stabilizing the temperatures, controlling the leakage flow rates, and compensating for the volumes of compressed gas, and wherein said hydraulic regulation means comprises at least one channel received at least partially by the rotor or the stator, which said at least one channel interconnects said at least two of said isolated cavities.

2. A pump according to claim 1, wherein said at least one channel is provided between said at least two isolated cavities which are adjacent to one another, whereby the hydraulic regulation means generates internal recirculation of the pumped fluid between said at least two adjacent isolated cavities.

3. A pump according to claim 1, wherein said at least one channel is provided between said at least two isolated cavities which are located in the vicinity of said outlet, whereby the hydraulic regulation means generates internal recirculation of the pumped fluid between said at least two cavities situated in the region of the pump that is in the vicinity of the outlet.

4. A pump according to claim 1, wherein there is a said at least one channel provided between all said isolated cavities, whereby the hydraulic regulation means generates internal recirculation of the pumped fluid between all of the isolated cavities of the pump.

5. A pump according to claim 1, wherein said at least one channel is received at least in part by the rotor.

6. A pump according to claim 5, wherein said at least one channel is a channel provided at the periphery of the rotor and interconnecting said two isolated cavities, and wherein the regulation is achieved by head loss.

7. A pump according to claim 5, wherein said at least one channel is provided in the rotor, and wherein the hydraulic regulation is performed mechanically by a regulator disposed inside said channel.

8. A pump according to claim 5, wherein the at least one channel is provided in the rotor, the hydraulic regulation being performed by head loss.

9. A pump according to claim 1, wherein said at least one channel is received at least in part by the stator.

10. A pump according to claim 9, wherein said at least one channel is an internal channel received by the stator with regulation by head loss.

11. The use of the pump as defined in claim 1, for pumping compressible multi-phase mixtures and for pumping viscous fluids.

12. A pump according to claim 1, wherein said helical stator is made of a compressible material.

* * * * *